US006779565B1

(12) United States Patent
Fawley

(10) Patent No.: US 6,779,565 B1
(45) Date of Patent: Aug. 24, 2004

(54) COMPOSITE REINFORCED GAS TRANSPORT MODULE

(75) Inventor: Norman C. Fawley, San Luis Obispo, CA (US)

(73) Assignee: NCF Industries, Inc., Santa Maria, CA (US)

( * ) Notice: Subject to any disclaimer, the term of this patent is extended or adjusted under 35 U.S.C. 154(b) by 0 days.

(21) Appl. No.: 10/392,561

(22) Filed: Mar. 19, 2003

(51) Int. Cl.[7] ..... B65B 1/04; B65B 3/04

(52) U.S. Cl. ..... 141/1; 141/69; 141/82; 141/85

(58) Field of Search ..... 141/1, 11, 69, 141/82, 83, 85, 95; 156/425, 429, 430; 220/581, 586, 588, 589, 590; 428/411.1, 418

(56) References Cited

U.S. PATENT DOCUMENTS

| | | | | | |
|---|---|---|---|---|---|
| RE31,960 | E | * | 7/1985 | Phillips | 428/418 |
| 4,559,974 | A | | 12/1985 | Fawley | |
| 5,287,987 | A | * | 2/1994 | Gaiser | 220/589 |
| 2003/0037885 | A1 | * | 2/2003 | Hauber | 156/425 |

FOREIGN PATENT DOCUMENTS

| | | |
|---|---|---|
| CA | 2181497 | 1/1998 |
| CA | 2299644 | 8/2001 |

OTHER PUBLICATIONS

Norman C. Fawley, *Report of Severe Abuse Tests Conducted on Composite Reinforced Aluminum CNG (Compressed Natural Gas) Vehicle Fuel Cylinders*, SAE Technical Paper Series 831068, pp. 27–38, CNG Cylinder Corporation.

*Basic Requirements for Fiber Reinforced Plastic (FRP) Type 3HW Composite Cylinders*, DOT article, Jan. 15, 1982 (original) and Jan. 4, 1987 (revision), pp. 1–20.

N. C. Henderson, S. C. Ford, F. A. Simonen and R. D. Winegardner, *Computer–Aided Stress Analysis, One–Cycle Burst Experiments, and Cyclic Fatigue Experiments on Fiberglass–Filament–Reinforced Aluminum Gas Cylinders for Use With the Swimmer Delivery Vehicle*, Summary Report, Mar. 1975, Supdiv Report No. 2–75, BATTELLE Columbus Laboratories.

C. J. Kuhlman, S. Roy, K. Pagalthivarthi and C. H. Parr, Southwest Research Institute—U.S.A., D. S. Stephens, R. B. Francini and T. J. Killinski, Battelle—U.S.A. and V. L. Hill, Gas Research Institute—U.S.A., *Repair of Damaged Gas Transmission Pipelines With Composite Material Reinforcements*, Article prepared for the 1992 International Gas Research Conference, pp. 610–619.

*CRLP Axial Fracture Arrest Resistance and Criterion*, Excerpt from Composite Reinforced Linepipe (CRLP) Engineering Due Diligence Final Report by Engineering Mechanics Corporation of Columbus, Oct. 2000, 6 pages.

*CRLP Axial Through–Wall Fracture Initiation Resistance and Criterion*, Excerpt from Composite Reinforced Linepipe (CRLP) Engineering Due Diligence Final Report by Engineering Mechanics Corporation of Columbus, Apr. 2000, 4 pages.

(List continued on next page.)

*Primary Examiner*—Timothy L. Maust
(74) *Attorney, Agent, or Firm*—Blakely, Sokoloff, Taylor & Zafman, LLP

(57) ABSTRACT

A system is disclosed for the manufacture and use of a composite reinforced gas transport module ("GTM"). A metal shell of the system is wrapped circumferentially with a composite reinforcement, the composite reinforcement is post cured and the metal shell is then pressurized beyond the yield point of its material to load the composite reinforcement. The system is then brought to ambient temperature. The expansion deformation of the metal shell due to pressurization beyond the yield point results in a loading of the metal shell by the cured composite reinforcement at ambient temperature. Thus, a negative hoop stress condition is created in the metal shell at ambient to reduce the hoop stresses created during subsequent pressured operation.

10 Claims, 4 Drawing Sheets

OTHER PUBLICATIONS

*Composed Reinforced Pressure Vessels* (*CRPV*)—*SC Pressure Vessels* (*SC VIII*), Presentation by TransCanada, May 17, 2001, pp. 9–14.

Craig Riley, Norman Fawley and Trevor MacFarlane, *Composite Reinforced Pressure Vessel Laminate Layer—Discussion Paper and Rationale*, Jun. 27, 2001, Article, pp. 1–17.

TransCanada, *Composite Reinforced Pressure Vessels* (*CRPV*)—*Special Working Group—High Pressure Vessels*, Jul. 25, 2001, Presentation by TransCanada, pp. 18–24.

*Appendix 2—Supporting Documentation*, Responses to Comments, Feb. 22, 2002, pp. iv–xi.

*Appendix 4—Consequence Discussion from Composite Reinforced Pressure Vessel Risk Assessment*, Responses to Comments, Feb. 22, 2002, 3 pages.

*Appendix 5—Simple Analysis of the Residual Stresses in a FRP/Steel Pressure Vessel Caused by Thermal Expansion*, Responses to Comments, Feb. 22, 2002, 4 pages.

TransCanada, *Gas Transport Module Inland Hopper Barge—Composite Reinforced Vessel Detail*, Drawing, Jan. 8, 2001, Drawing No. A1–DWG–ME–001.

Tom Zimmerman, Gary Stephen and Alan Glover, *Composite Reinforced Line Pipe* (*CRLP*) *for Onshore Gas Pipelines*, Presentation, Dec. 2001, 35 pgs.

* cited by examiner

COMPOSITE REINFORCED GAS TRANSPORT MODULE

BACKGROUND OF THE INVENTION

1. Field of the Invention

The invention relates to the field of composite reinforced materials. In particular, the invention relates to transport of highly compressed gas with high pressure tanks reinforced with composite wraps.

2. Related Art

Gas transport systems exist for the movement of natural gas or other heavy hydrocarbons from the field to market. Steel pipelines provide a traditional system solution, but are becoming more expensive to install as the pressure and distance requirements increase over time. Removal of gas from remote locations using pipelines is expensive and sometimes politically impossible. Deliberate destruction of a portion of the steel pipeline due to terrorism or sabotage may cause a propagating ductile fracture or ripping failure in the axial direction of the pipeline that is expensive to rebuild and repair. Also, problems with multi-point collection of gas and delivery from those remote sources raise the cost of transportation using traditional pipeline methods.

Collection and transportation of gas from offshore sources to onshore markets using pipelines often poses regulatory and environmental challenges as well. These delays inhibit realizing immediate return on investments made to find the offshore sources. This increases the cost of collection and transport and often prevents the gas from reaching the market.

Pressure vessels may be used to transport gas from remote or off shore locations. However, present methods of manufacture produce relatively heavy modules that are expensive to transport. For example, all steel pressure vessels designed with Grade X65 steel having a 42 inch outer diameter and 1 inch wall thickness approach 437 pounds per foot. Not only are the modules difficult to transport due to their weight, the pressure vessels may also suffer from vulnerability to physical damage during transport. Other challenges include corrosion due to the environment and stress corrosion caused by reaction of the transported gas with the material of the pressure vessel.

Traditional practice attempts to lower the cost of transport due to weight and durability concerns by producing transport modules with stronger and stronger steels. In steel welded pressure vessels, hoop strength may be calculated as one half the longitudinal strength. This proportional relationship results in utilization of higher strength steel at higher operating hoop stresses to accomplish increased pressure design requirements. Unfortunately, these stronger materials tend to suffer from increased brittleness, corrosion, and difficulties associated with welding.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION OF THE EXAMPLE EMBODIMENTS

A high strength, durable and lightweight gas transport module ("GTM") is manufactured in a process designed to be portable among manufacturing plants around the world, allowing it to be incorporated into any pressure vessel manufacturing facility. In an example embodiment, a steel welded pressure vessel may be preheated, primed, and wrapped circumferentially on its exterior surface with a composite layer reinforcement ("composite reinforcement"), a woven roving to prevent later circumferential cracking of the composite's matrix and a single layer of a polyester veil or glass mat for ultraviolet protection of the fibers. The composite reinforcement may then be cured to a B-stage and post cured with introduction of steam into the pressure vessel. Water may then be introduced into the pressure vessel for a hydrotest at a pressure to place the hoop stresses of the steel shell of the pressure vessel into the plastic region of its stress-strain curve. The fibers of the composite reinforcement remain in their elastic region during hydrotest. The pressure vessel is then brought back down to ambient. The process results in a loading of the steel shell by the composite reinforcement producing lower hoop stresses in the steel shell at operating pressures. The traditional notion of hoop strength (HS) being equal to one half longitudinal strength (LS) in pressure vessels is modified with introduction of the composite reinforcement (CR) to reinforce the steel shell. Now, more accurately, hoop strength plus composite reinforcement strength may equal the longitudinal strength. Thus, the basic relationship of side wall load to end to end load is changed because of the composite reinforcement, from HS=½ LS to HS+CR=LS.

Figure 1:
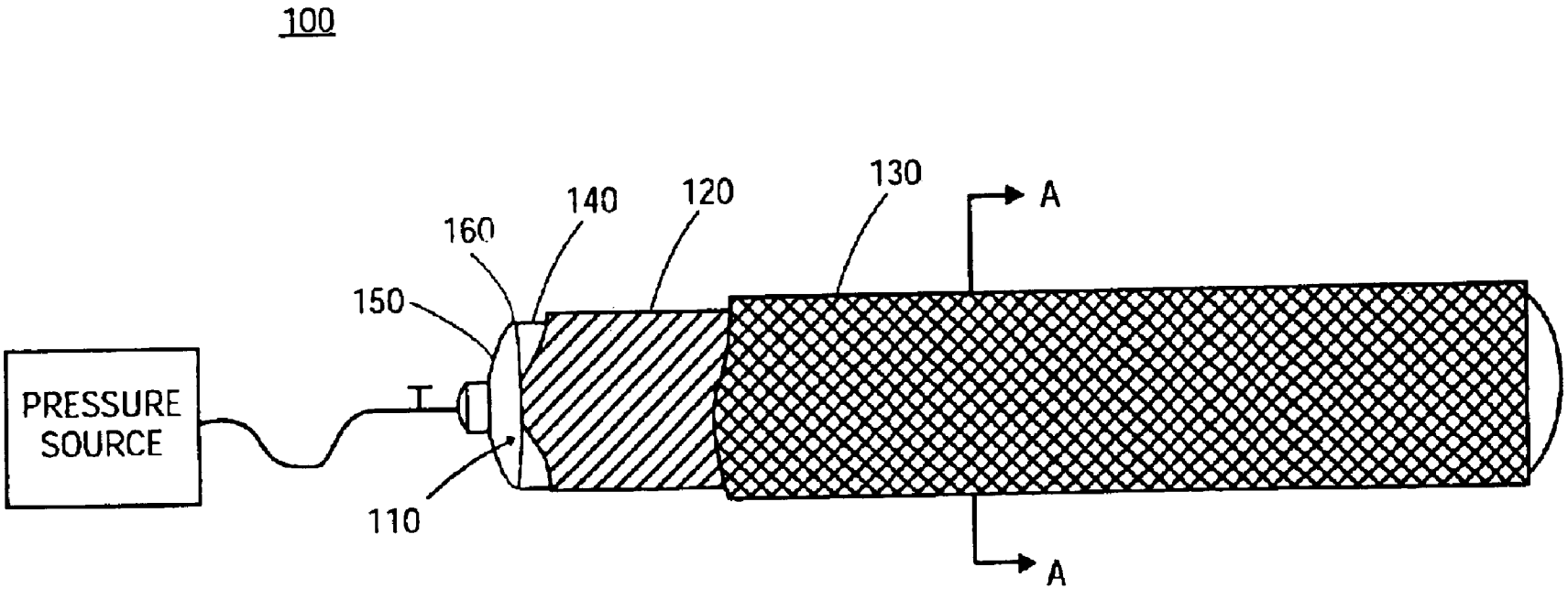
FIG. 1 is a side plan view of one example of the system of the invention.

FIG. 1 shows GTM 100 connected to a steam and pressure source 140. A metallic pressure containment vessel 110 ("pressure vessel 110") may be manufactured of any metal, metal alloy, or elastic metal composite. Examples of metal include, but are not limited to, steel, stainless steel, high strength low alloy steel, carbon steel, monel, inconel, hastelloy, and titanium. The pressure vessel 110 need not be manufactured exclusively of metal or metal alloys, however. Some combination of metal, metal alloy or other material might be used that together exhibit impermeability to natural gas and its constituents. Another property of interest, as shown below, is that of elasticity and plasticity subsequent to reaching an upper yield point. As such, any manner of material or combination of materials might be used that exhibit these characteristics. In an embodiment, the pressure vessel may be manufactured with metal shell 140 and metal head 150, with weld 160 composed of higher strength metal and/or utilizing a higher volume than would otherwise be used to overmatch the joint for better performance during hydrotest (block 290) (see FIG. 2). This overmatch compensates for the increased end to end load permissible with the composite reinforcement. In one embodiment, the weld 160 is overmatched by selecting a weld material that is stronger (e.g., has a tensile strength 10%–12% greater) than the tensile strength of the material of the head 150 and shell 140. In anther embodiment, the weld 160 is overmatched by using a larger volume of weld material per unit area than is present in the adjacent head 150 and shell 140. Typically, a volume greater by 15% to 18% may be used. In some cases, weld 160 may be overmatched in both strength and volume.

Composite reinforcement 120 is shown wrapped around pressure vessel 110. Composite reinforcement 120 may be made with an isopolyester resin matrix with E glass, fibers. In an example embodiment, any fibers with similar strength and elasticity characteristics may be used such as S glass, carbon, aramid or polyester. For use of the GTM 100 in warm environments, the isopolyester resin may be AOC 701 isopolyester resin with a 1 ½% elongation and 224 degree Fahrenheit heat distortion temperature. In another example embodiment, AOC 757 isopolyester may be used exhibiting a 4% elongation and 176 degree Fahrenheit heat distortion temperature. The appropriate elongation characteristic depends in part on the planned environment for the GTM 100. Typically, a tradeoff exists in isopolyester resins between heat distortion temperature characteristics and elongation characteristics. A commercial isopolyester resin mixed for a high heat distortion temperature, such as would be desired for use in high temperature environments such as those found at the Equator, results in an isopolyester with lower elongation. Similarly, a commercial isopolyester mixed for composites to be used in colder environments, such as in the Arctic, would result in an isopolyester with higher elongation. An isopolyester resin demonstrating 30% elongation may be appropriate for use in the Arctic. In an alternative embodiment, the isopolyester resin may be substituted with any resin with adequate strength and elongation characteristics to support the fibers, including but not limited to polyester, epoxy, or polyurethane resins. In another example embodiment, the resin is manufactured using polyester fibers (resin in a fiber form). One current commercial product consisting of polyester/polypropylene fibers co-mingled with glass fibers is sold as Twintex™, available from Saint-Gobain Vetrotex America in Maumee, Ohio, USA.

Referring again to FIG. 1, composite reinforcement 120 is shown with fibers running substantially in the circumferential direction with no perpendicular fibers. Thus, most of the strength conferred to the pressure vessel 110 is reserved for hoop stresses. Chafing due to tension and compression of the layers may also be reduced in this configuration. The ends of the pressure vessel may not be wrapped. It may be appreciated that the thickness of the composite reinforcement 120 depends on the amount of reinforcement desired and may be influenced by the operating pressure, the steel strength and the weld. As such, any manner of thickness will suffice to provide further hoop strength reinforcement for the pressure vessel 110. In an alternative embodiment, the composite reinforcement 120 does not have the fibers running in substantially the circumferential direction with no perpendicular fibers, but rather has fibers of sufficient density, number and strength when wrapped to provide desired hoop strength for the pressure vessel 110. As described above, the composite reinforcement may be manufactured with any composition of fiber allowing for sufficient strength and for appropriate elasticity. Although 1 ½% elongation resin may be used, more elastic resins, such as 30% elongation resin, may be used depending on weathering characteristics desired. While the foregoing description is in the context of a pressure vessel, the same reinforcing techniques may be applied to pipe, e.g., for transporting pressurized fluid in a pipeline.

FIG. 1 also shows a resin reinforcement tape that, in an embodiment, may be a woven roving 130. Woven roving 130 is shown wrapped circumferentially around composite reinforcement 120 to prevent circumferential shrink cracking of the resin in the composite reinforcement 120 during cure and expansion cracking of the resin during hydrotest. An example embodiment of the woven roving includes PPG-2026. Eighteen or twenty-four ounce woven roving in a standard 5×4 configuration may also be used. In an alternative embodiment, the resin reinforcement tape made of woven roving 130 may be replaced with ±90 degree stitched fabric. In another alternative embodiment, woven roving is replaced with a braided fabric or an 80/20 warp and weft woven fabric. Tri Ax fabric or a weft only fabric may also be used. It may be appreciated that other woven, stitched, or braided materials may be used to provide bi-axial or weft dominated fiber geometry. Also of concern is the ability of the woven roving 130 or substitute material to saturate with resin from underlying composite reinforcement 140 prior to cure. A fighter weave such as triaxial fabric may not be as ideal to wick up resin due to the density of the weave.

Figure 2:
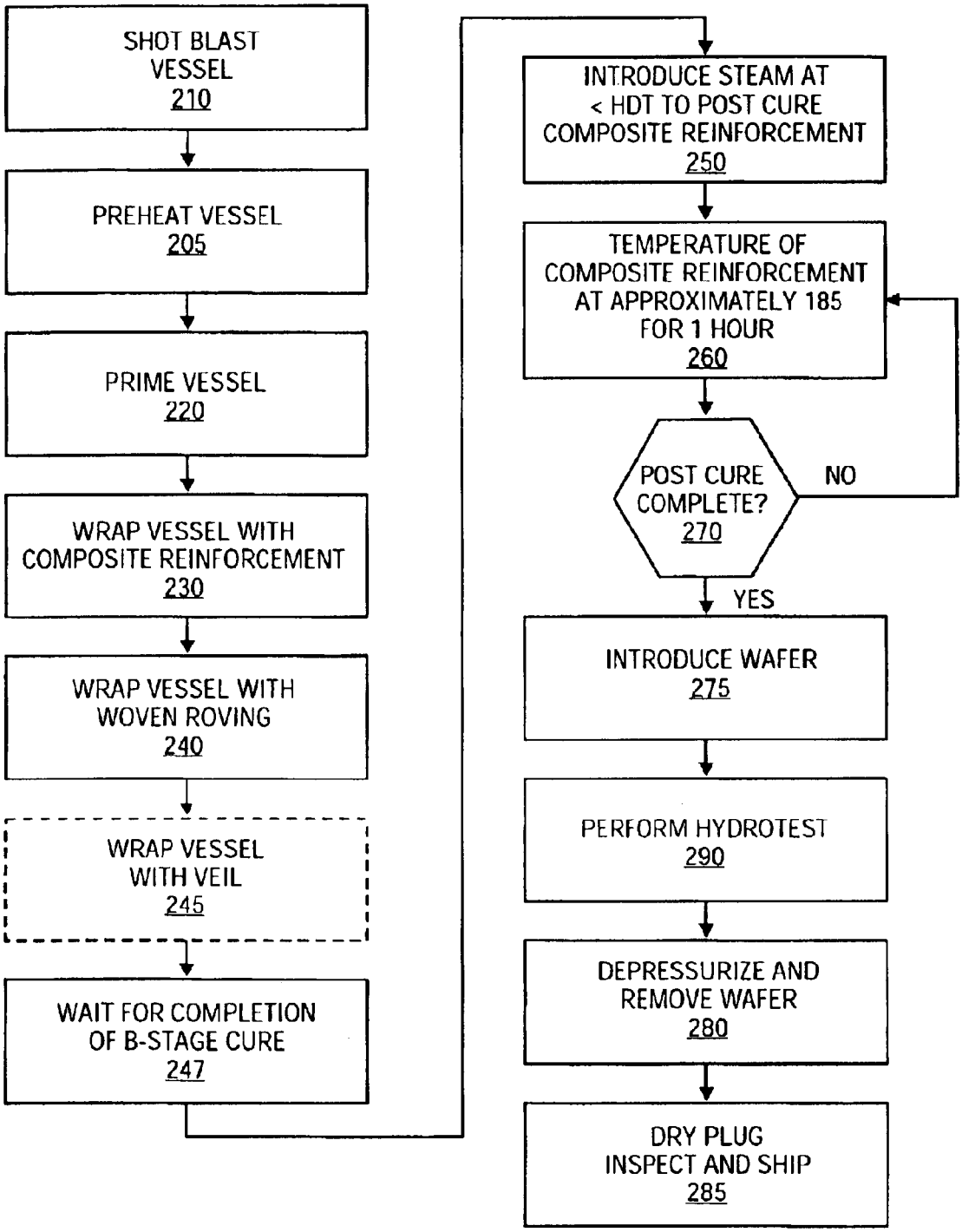
FIG. 2 is a flow diagram of an example method of the invention.

FIG. 2 is a flow chart showing a method of manufacturing the GTM 100. The pressure vessel 110 may be shot blasted (block 210). In an alternative embodiment to shot blasting, the pressure vessel 110 may be subjected to metallic abrasives or provided with a similar surface treatment. The pressure vessel 110 may be preheated to approximately 100–125 degrees Fahrenheit to remove moisture (block 205). It may be appreciated that the purpose of preheating the pressure vessel 110 is also to encourage onset of cure of the cure of subsequent application of the composite reinforcement 120. As such, the appropriate temperature for preheating the pressure vessel 110 depends on the composition of the resin used for the composite reinforcement 120 and the speed at which the cure is to be accomplished. In one embodiment, steam may be introduced into the pressure vessel 110 to preheat the pressure vessel 110. In an alternative embodiment, an induction heater may be used to heat the pressure vessel 110. As the cure process becomes increasingly exothermic the underlying material functions as a heat sink to reduce the temperature of the composite and thereby reduced tendency for surface cracking during cure (described in more detail below).

The primer may then applied (block 220) and may consist of an isovinylester which has been shown to exhibit beneficial strength characteristics and durability. In an example embodiment, AOC 5017 primer may be used. In other embodiments, the primer may be selected from any number of commercial types of products including GP Ortho, Laminating-iso, or Brom Vinyl Ester primers.

The pressure vessel 110 may then have the composite reinforcement 120 applied (block 230). The fibers of composite reinforcement 120 may be drawn through a resin bath and wound onto the previously primed and heated pressure vessel 110 (see block 205). Excess resin may be physically removed as the composite reinforcement is built up such as through scraping, brushing, or through some other suitable means. In this manner, for a pressure vessel 110 using Grade X65 steel having a wall thickness of 0.469 inches and an exterior diameter of 42 inches, the composite reinforcement 120 is built up on the pressure vessel 110 to a thickness approximating ½ to ¾ inches to balance the hoop and longitudinal loads for an operating pressure of approximately 1,000 psi. (block 230). In an alternative embodiment, the composite reinforcement 120 is barber polled around the pressure vessel using a suitable wrapping mechanism. Typically, the composite reinforcement adds 20% to the weight of the vessel while increasing the pressure capability by 100%.

The last layer of composite reinforcement 120 may be allowed to have more resin than previous layers to allow for subsequent application of woven roving 130. A woven roving 130 may then be wrapped around the composite reinforcement 120 (block 240). In an example embodiment, a 12 inch wide woven roving 130 is wrapped around a 40-inch diameter pressure vessel 110 having a previously wrapped composite reinforcement 120 to form a 5 degree lay angle. In an alternative embodiment, a weft dominated fabric may be utilized with the majority of fibers running in the longitudinal direction to support the composite reinforcement 120. In another alternative embodiment, triaxial fabric is wrapped around composite reinforcement 120. Any variety of stitched, braided or other material may be used to reduce cracking of the composite reinforcement during subsequent cure and hydrotest. The woven roving 130 or other suitable material may wick up resin from the composite reinforcement 120 to reduce air pockets trapped in the composite reinforcement 120 (block 240). A polyester veil or glass mat may then be wrapped around woven roving 130 to further wick up resin to remove air pockets and to protect the glass fibers of the woven roving 130 and composite reinforcement 120 from the harmful effects of weathering over time (block 245).

The heat from previously heated pressure vessel 110 (block 205) in conjunction with a resin catalyst encourages the resin of the composite reinforcement 120 to begin the B-stage cure (block 247). As the exothermic curing process of the composite reinforcement 120 progresses, the temperature of the composite reinforcement 120 is reduced from what it would otherwise be by absorption of heat energy back into the pressure vessel 110. Thus, the previously heated pressure vessel 110 both encourages the onset of the B-siage cure by providing energy to the resin matrix of the composite layer 230 and serves as a heat sink for the resin as the exothermic B-stage cure progresses. This reduced overall temperature of the curing composite reinforcement 120 reduces the likelihood of cracking in the resin due to increased composite reinforcement 120 temperatures that the surface temperature of the laminant may approach –130–160 degrees Fahrenheit.

In an alternative embodiment, pressure vessel 110 may be wrapped with load bearing fibers and resin in fiber form for cure as it is wrapped. The composite reinforcement 120 in this embodiment may be composed of Twintex™ and may be post cured by bringing the assembly through a heat tunnel at 450 degrees Fahrenheit thereby melting the polypropylene or polyester co-mingled fibers. In an alternative embodiment, the fibers are heated concurrently with winding onto pressure vessel 110 to kick off the B-stage cure (block 247).

In another alternative embodiment, the pressure vessel 110 is chilled to shrink and the composite layer 120 is wrapped in tension. As the pressure vessel 110 warms and expands, the previously tensioned composite layer 120 loads the pressure vessel 110.

After the initial B-stage cure of the composite reinforcement 120 (block 247), steam may be introduced into the pressure vessel 110 at a heat below the heat distortion temperature of the composite reinforcement 120 (block 250) to perform post cure (blocks 260, 270) of the composite reinforcement 120. In an example embodiment, a AOC 757 Isopolyester resin may be used in the composite reinforcement 120 and the pressure vessel is brought to approximately 185 degrees Fahrenheit for approximately one hour to perform post cure (blocks 260, 270). In an alternative embodiment, an induction heater is placed adjacent to the pressure vessel 110 to heat the underlying metallic material for post cure. The exterior surface of the composite reinforcement 120 may also be heated through the use of UV light, RF, or infrared heat to a point less than the heat distortion temperature of the composite matrix to post cure. It may be appreciated that the temperature and length of the post cure is tailored to the type of resin used in the composite reinforcement 120 and to the desired post cure time. As such, If the composite reinforcement matrix is such that means other than heat are used to post cure, appropriate methods of post cure may be utilized.

Cool water may then be introduced into the pressure vessel 110, such that the heat of the pressure vessel warms the water in advance of hydrotest 120 (block 275) and the pressure vessel 110 is pressurized to a point above the yield point of the metal shell 140 for hydrotest (block 290). Hydrotest typically occurs at 1.25–1.75 times the expected service pressure, and at a temperature between 125° F. and 150° F. In an example embodiment of the invention, the cool water approaches approximately 125 degrees Fahrenheit from the residual heat of pressure vessel 110 thereby reducing cracking of the composite reinforcement 120 during hydrotest. The pressure vessel 110 is then depressurized and the water removed (block 280). In an example embodiment, the metal shell 140 may remain in the plastic region for approximately two or three minutes before depressurizing the pressure vessel 110 to obtain a desired circumferential expansion and loading of the fibers of the composite reinforcement 120. When the system is depressurized, a residual hoop strain remains, which leaves the plastically deformed metal shell 140 with a compressive residual stress. By way of example and not of limitation, a API LX-70 steel pipe having a 1067 mm diameter and a thickness of 19 mm with a composite reinforcement 120 of 14 mm may begin to see the metal shell 140 yield at 18 MPa. The final hydrostatic test pressure may reach 23 MPa. When such a system is depressurized and the water removed, a residual hoop strain of 0.2% may remain, with a compressive residual stress in the metal shell 140 of 72 MPa and tensile residual stress of 100 MPa in the composite reinforcement 120. After the vessel is depressurized it may be dried, plugged, inspected and it is then ready to ship (block 285).

Figure 3:
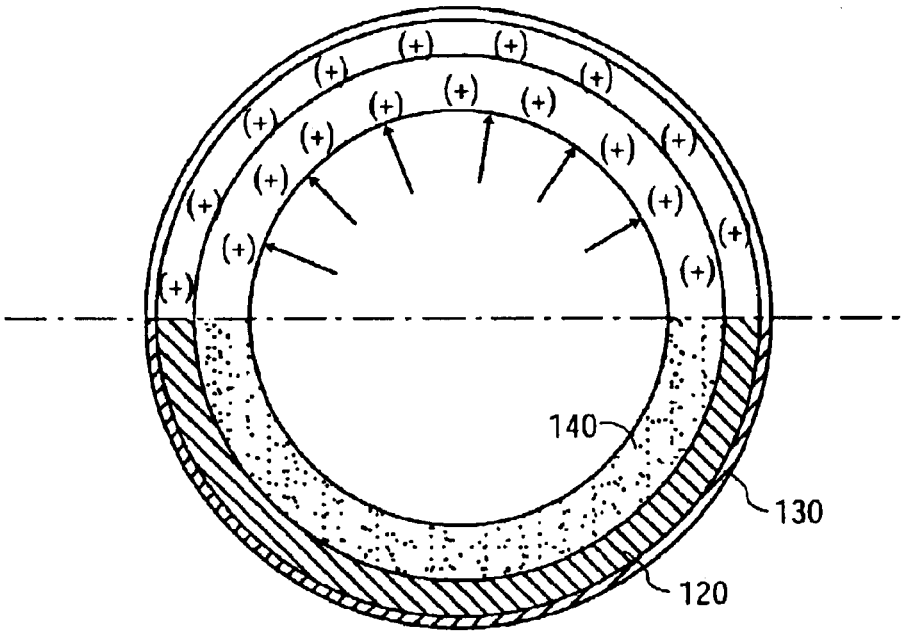
FIG. 3 is a cross-sectional view showing hoop stresses during hydrotest in an example of the invention.

FIG. 3 shows the cross section A—A in FIG. 1 taken of the GTM 100. During pressurization to the hydrotest pressure, the metallic shell 140 is placed under positive hoop stress. The fibers of the composite reinforcement 120 are also loaded during this process, but do not exceed their ultimate tensile stress 530 (see FIG. 5).

Figure 4:
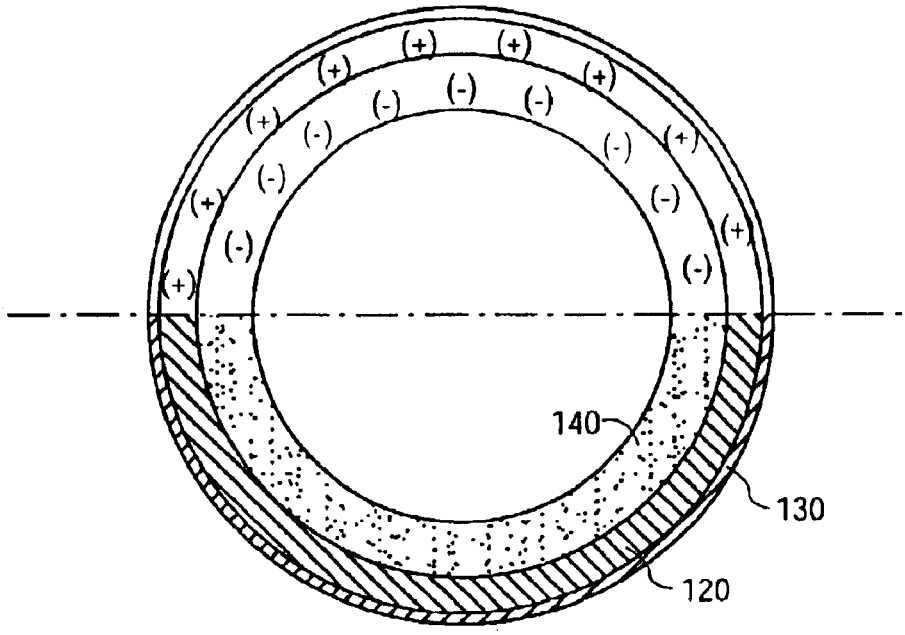
FIG. 4 is a cross-sectional view showing hoop stresses in an ambient state in an example of the invention.

FIG. 4 shows hoop stresses in pressure vessel 110 as the post cure is completed (block 270) and the pressure vessel 110 depressurized with removal of the water (block 280). As the GTM 100 pressure and temperature is returned to near ambient, the metallic shell 140 experiences sustained negative hoop stress due to compression by the composite reinforcement 120. Pressurization of the pressure vessel 110 beyond the yield point of the metallic shell 140 results in a permanent expansion in both circumferential and longitudinal directions of the pressure vessel 110. By way of example and not of limitation, hydrotest of a composite wrapped 70 ksi steel (API 5LX70) pressure vessel having an exterior diameter of 1067 mm and a length of 24.7 meters may result in a permanent expansion approximating two inches in the longitudinal direction. As shown in FIG. 4, this permanent plastic deformation results in sustained compression by the composite reinforcement 120 with respect to the metallic shell 140. The metallic shell 140 experiences negative hoop stress at ambient due to the compression by the cured composite reinforcement 120. During subsequent pressurization during normal operation, the hoop stresses normally associated with a particular internal pressure are reduced due to the compression by the composite reinforcement 120. The operational compression of the metallic shell 140 by the composite reinforcement 120 provides the beneficial result of reduced hoop stresses and the commensurate reduction in fatigue and stress corrosion over time. The mean time between failure for the GTM 100 is thus increased. Metallic wall thickness requirements for the metallic shell 140 are also reduced resulting in a net loss of weight in comparison to comparably designed all-metallic pressure vessel. In one embodiment, the weight reduction is approximately 40% for the same pressure and diameter.

Figure 5:
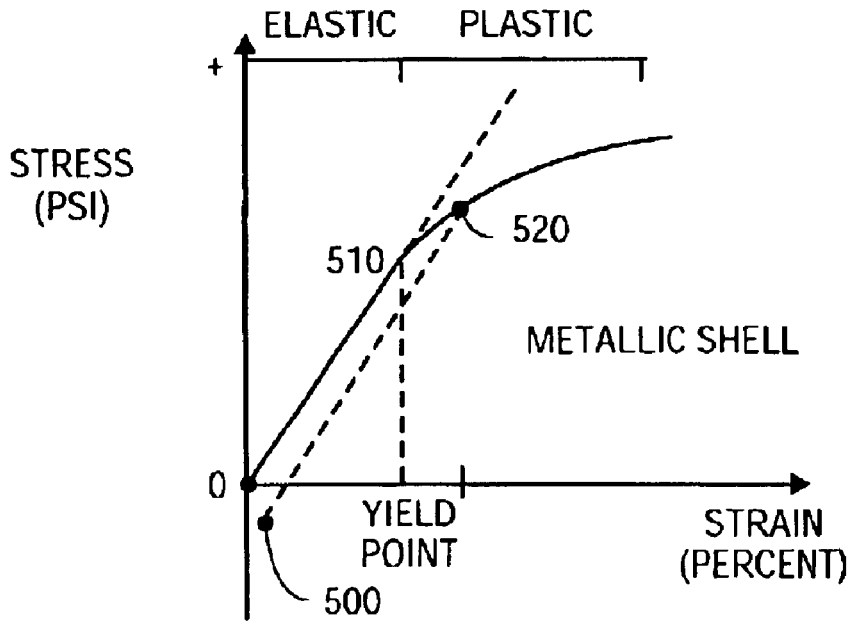
FIG. 5 is a stress-strain graph in an example of the invention.
Figure 5:
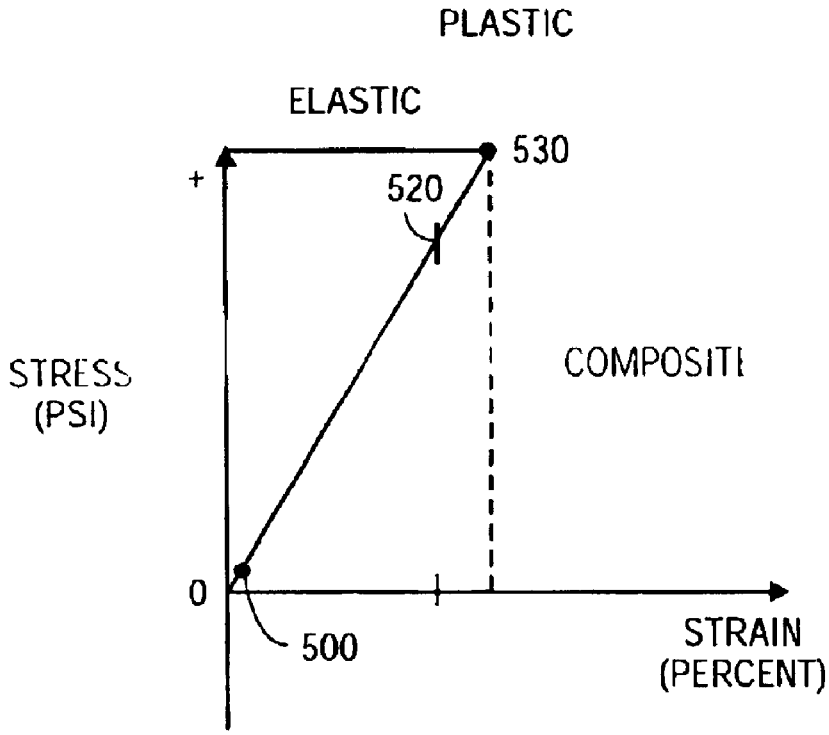

FIG. 5 shows a stress-strain graph of the metallic shell 140 material as the system is pressurized with fluid. The internal pressure of the pressure vessel 110 continues past the yield point 510 of the metallic shell 140 material to a hydrotest pressure resulting in the metallic shell experiencing stress in the plastic region 520 thus causing permanent expansion deformation of the pressure vessel 110. The fibers of the composite reinforcement 120 are loaded due to the expansion deformation and cure. The composite reinforcement 120 fibers remain in their stress-strain elastic region at all times during the hydrotest. As hydrotest pressure is removed (block 280), the metallic shell 140 maintains an elastic position 500 that is larger in dimension than prior to pressurization (block 290). The composite reinforcement 120 fibers remain in tension after the hydrotest and consequent increase in pressure vessel 110 diameter. Thus, the pressure vessel 110 of the GTM 100 is brought to a negative hoop stress state at ambient resulting in lower hoop stresses during normal operation.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

I claim:

1. A method comprising:

wrapping a composite reinforcement circumferentially around a pressure containment vessel;

applying heat to cure the composite reinforcement;

pressurizing the pressure containment vessel beyond the elastic region of the pressure containment vessel material to load the composite reinforcement; and depressurizing the pressure containment vessel.

2. The method of claim 1 further comprising:

priming the exterior of the pressure containment vessel.

3. The method of claim 1 wherein applying heat comprises:

injecting steam into the pressure containment vessel at a temperature greater than a heat distortion temperature of a resin in the composite reinforcement.

4. The method of claim 1 wherein applying heat comprises:

placing an induction heater adjacent to and circumferentially around the composite reinforcement to heat the pressure containment vessel to a temperature greater than a heat distortion temperature of the composite reinforcement.

5. The method of claim 1 further comprising:

wrapping a woven roving circumferentially around the composite reinforcement.

6. A method comprising:

priming a metallic pressure containment vessel;

wrapping a composite reinforcement circumferentially around the metallic pressure containment vessel;

pressurizing the metallic pressure containment vessel beyond the elastic region of the metallic containment vessel to load the composite reinforcement;

applying heat to the composite reinforcement; and depressurizing the metallic pressure containment vessel.

7. The method of claim 6, wherein the applying heat comprises:

injecting steam into the metallic pressure containment vessel at a temperature greater than a heat distortion temperature of a resin in the composite reinforcement.

8. An apparatus comprising:

a composite reinforcement wrapped circumferentially around a metallic pressure containment vessel; and a water pressure source coupled to the pressure containment vessel to pressurize the pressure containment vessel to a pressure beyond the yield point of the pressure containment vessel;

wherein the water provided to the pressure containment vessel is at a temperature below a heat distortion temperature of a resin in the composite reinforcement.

9. The apparatus according to claim 8, wherein said metallic pressure containment vessel comprises:

a shell; and a head coupled to said shell at a joint;

wherein the joint comprises material with a tensile strength greater than the tensile strength of the shell and the head.

10. The apparatus of claim 8 the metallic metal containment vessel comprises:

a shell; and a head coupled to the shell at a joint wherein the joint material has a volume per unit area greater than the shell and the head.

* * * * *